United States Patent [19]

Feldman

[11] Patent Number: 4,616,893

[45] Date of Patent: Oct. 14, 1986

[54] SURFACE MOUNT, MINIATURE, BUSSING CONNECTOR

[75] Inventor: Steven Feldman, Seminole, Fla.

[73] Assignee: AMP Incorporated, Harrisburg, Pa.

[21] Appl. No.: 603,802

[22] Filed: Apr. 25, 1984

[51] Int. Cl.[4] ..... H01R 9/09

[52] U.S. Cl. ..... 339/14 R; 339/17 M; 339/125 R

[58] Field of Search ..... 339/14 R, 17 R, 17 C, 339/17 LM, 17 M, 17 CF, 143 R, 125 R, 126 R, 131, 132 B; 361/407

[56] References Cited

U.S. PATENT DOCUMENTS

| | | | |
|---|---|---|---|
| 3,434,094 | 3/1969 | Walter | 339/17 R |
| 3,448,345 | 6/1969 | Koehler, Jr. et al. | 361/407 |
| 3,871,728 | 3/1975 | Goodman | 339/17 R |
| 3,873,173 | 3/1975 | Anhalt | 339/17 CF |
| 3,984,166 | 10/1976 | Hutchison | 339/17 CF |
| 4,133,592 | 1/1979 | Cobaugh et al. | 339/17 M |
| 4,331,370 | 5/1982 | Andrews et al. | 339/17 M |
| 4,349,238 | 9/1982 | Showman et al. | 339/17 CF |
| 4,420,767 | 12/1983 | Hodge et al. | 357/81 |
| 4,433,886 | 2/1984 | Cassarly et al. | 339/14 R |

OTHER PUBLICATIONS

IBM Bulletin, Aug et al., vol. 19, No. 5, p. 1835, 10-1976.

*Primary Examiner*—Neil Abrams

*Attorney, Agent, or Firm*—Russell J. Egan; Robert W. Pitts

[57] ABSTRACT

A surface mount, miniature connector with an integral power or ground bus bar is formed by a pair of mating housing members each defining a mating face and an oppositely-directed surface mount face with a plurality of terminal passages extending between the faces. A like plurality of terminals is provided, each mounted in a respective passage with a mating portion directed towards the mating face and a solder tail extending from the surface mount face. Each housing is provided with an elongated longitudinally extending groove which receives therein an elongated rigid conductive bus bar member having at least one leg which extends beyond the surface mounting face of the respective housing. Each bus bar is of sufficient length to bus at least one connector housing and to provide strength to the underlying circuit board and prevent the connector from being pulled off the mounting surface during connector unmating. Each connector is further provided with an H-shaped clip for interengaging bus bars of the plug and receptacle members.

15 Claims, 4 Drawing Figures

SURFACE MOUNT, MINIATURE, BUSSING CONNECTOR

The present invention relates to a surface mount miniature bussing connector and, in particular, one which can be utilized to provide added strength or stiffening to a circuit board as well as controlled impedance for the circuits.

The continued trend towards high density circuitry has created the need for miniature electric connectors which can be mounted on the surface of a circuit board so that cost and board real estate required by plated through holes used to conventionally mount known electrical connectors are eliminated. Surface mounting allows for the use of lighter weight circuit boards which, in turn, creates problems such as inadequate engagement of the terminals with the board, cracking of the solder interface, and inadequate engagement with mating terminals of another connector. Other problems of known surface mount connectors include the requirement for a secondary fastening operation such as screws, bolts, rivets, and heat stakes. Conventional connectors modified for surface mounting typically have exposed terminals which are subject to handling damage, enclosed terminals which cannot be inspected, terminals which are not sufficiently compliant to withstand relative movement due to thermal and mechanical forces, and inadequate spacing to allow repair. Also, power and ground have required the dedication of an excessive number of terminals in the known connectors.

The present invention obviates many of the foregoing difficulties by providing a surface mountable, miniature, bussing connector having a housing which defines a plurality of terminal passages extending between a mating face and a surface mount face, a like number of terminals are provided each mounted in a respective cavity and having a profiled mating end directed towards the mating face and a compliant solder tail extending from the surface mount face of the housing. The housing also includes an elongated longitudinally extending groove opening on the mating face and having at least one leg passage extending to the surface mount face. An elongated bus bar member of rigid conductive material and having at least one integral depending leg is positioned in each groove with each leg depending through a respective passage in the housing. Each connector can further be provided with at least one H-shaped clip to common bus bars of mating connectors.

The present invention will be described by way of example with reference to the accompanying drawings in which.

Figure 1:
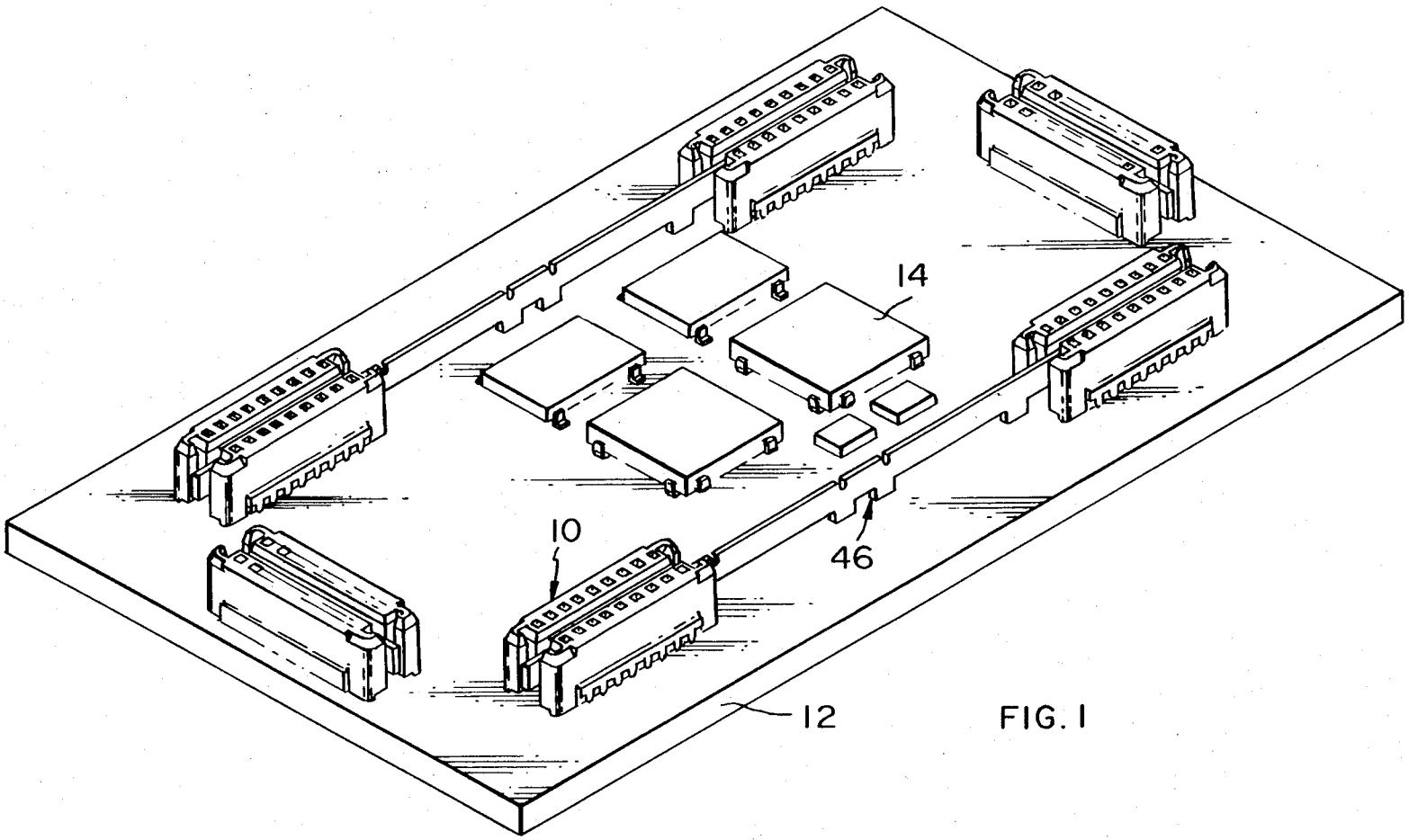
FIG. 1 is a perspective view of a circuit board provided with connectors in accordance with the present invention.

The subject surface mount, miniature, bussing connector 10 is shown in FIG. 1 as it would be utilized on a circuit board 12 having a plurality of preferably surface mounted electronic and electrical components 14 thereon.

Figure 2:
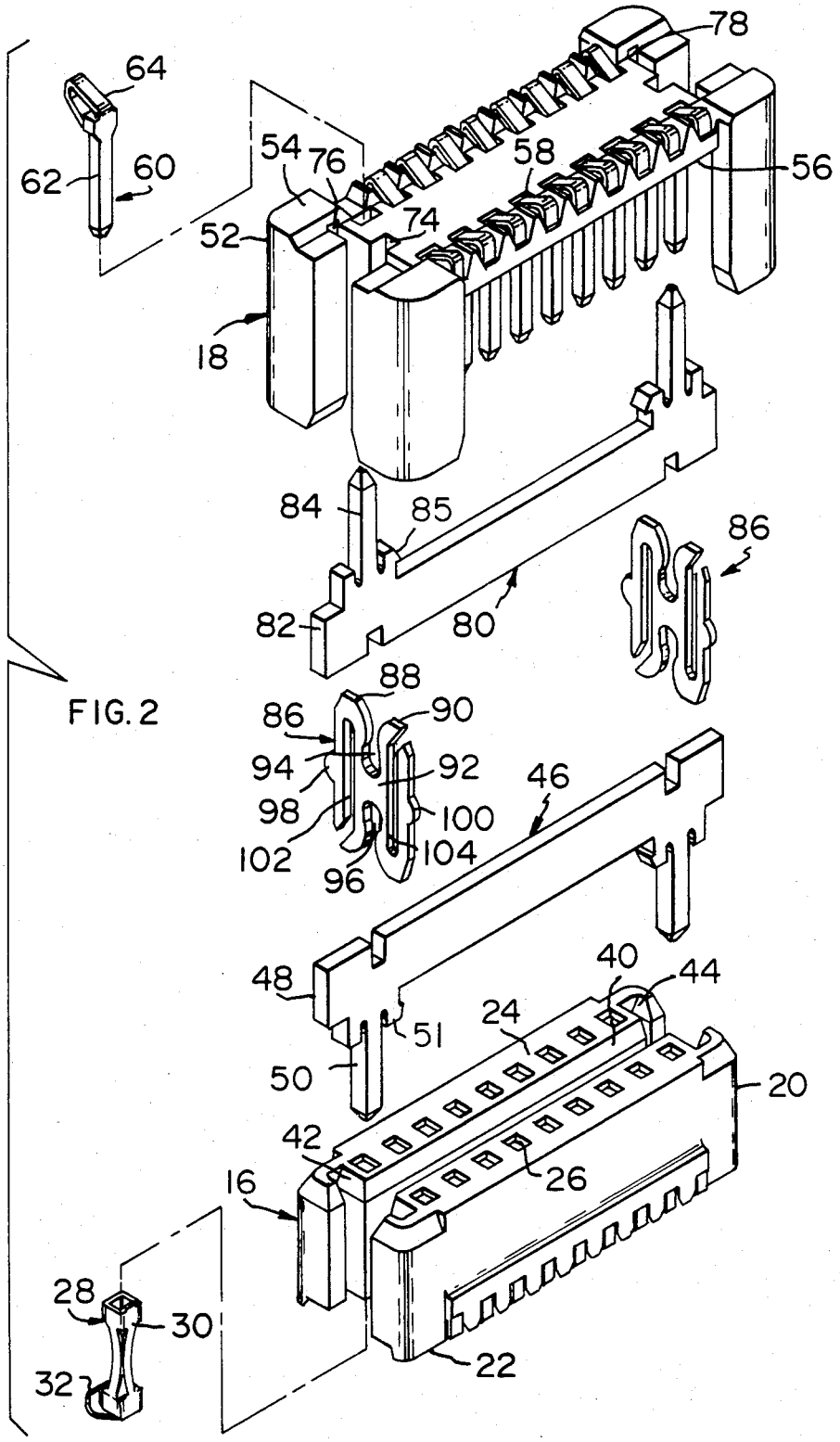
FIG. 2 is an exploded perspective view of a mating pair of connectors according to the present invention.
Figure 3:
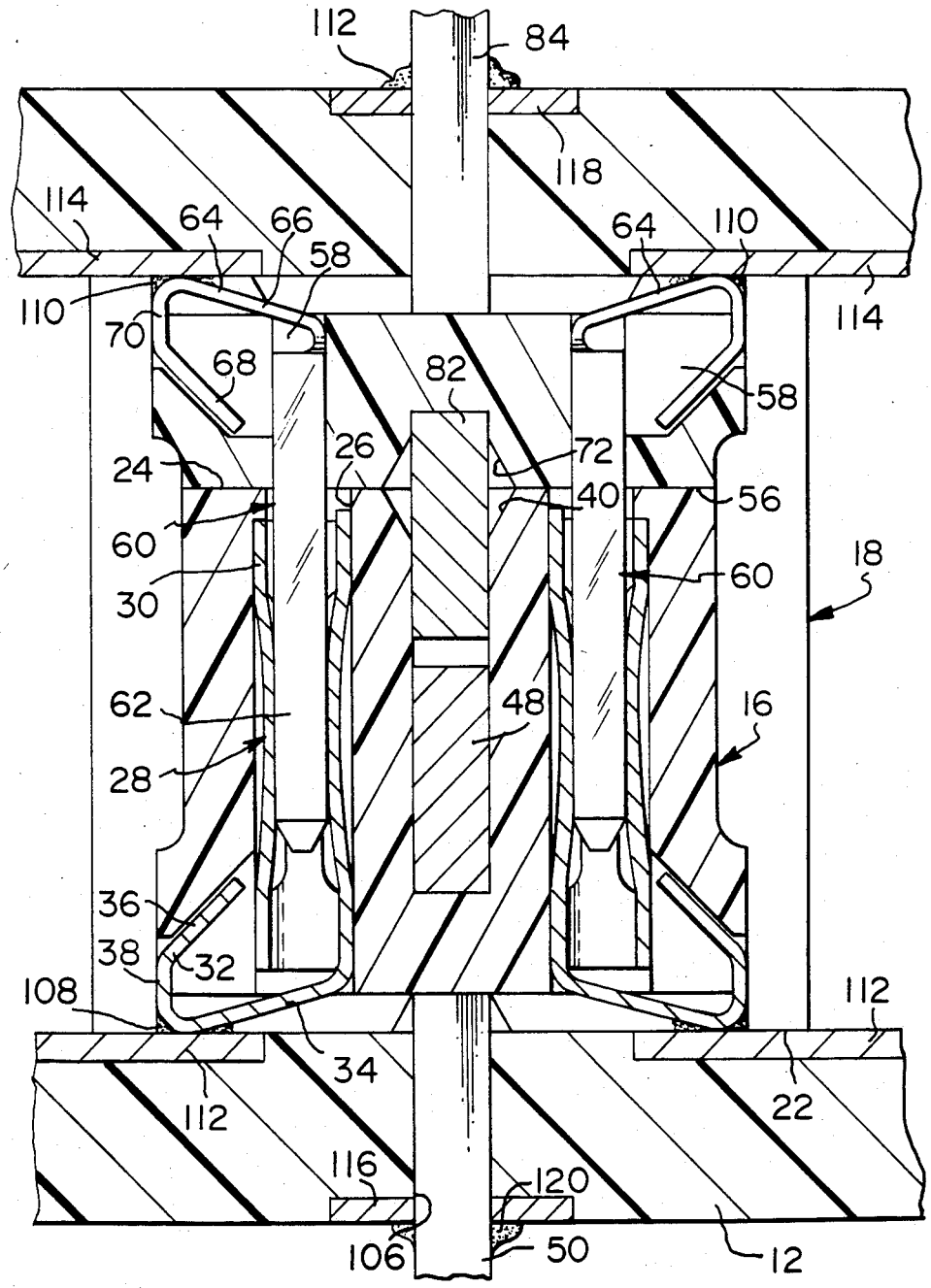
FIG. 3 is a transverse section through a pair of connectors according to the present invention in an assembled and mated condition.

The present invention can perhaps be best understood from FIG. 2 which illustrates all portions of a mating pair of connectors. The connector 10 includes a receptacle member 16 and a plug member 18. The receptacle member 16 has an elongated housing 20 of rigid insulative material defining a surface mounting face 22 and an oppositely-directed mating face 24 with a plurality of terminal passages 26 extending therebetween. A like plurality of receptacle terminals 28 are provided each mounted in a respective passage 26 and having a receptacle portion 30 and a surface mounting solder tail 32 defined by a cantilever beam segment 34 extending at an oblique angle from the axis of the receptacle portion 30 and a reversedly turned free end 36 defining a bight or nose 38, see FIG. 3. The housing 20 includes an elongated longitudinally extending bus bar groove 40 having at least one leg passage (not shown) opening onto the surface mounting face 22. The housing 20 also has profiled commoning clip cavities 42, 44 at the opposite ends thereof. An elongated bus bar 46 is formed of heavy conductive stock material and has a body 48 with at least one leg 50 depending therefrom and aligned to be received in a respective passage of housing 20. The bus bar 46 is received in the slot 40 with the legs 50 depending from the surface mounting face 22, as can best be appreciated from FIG. 3, and can be retained therein either by friction fit or by barbs 51.

The plug housing 52 is also of a rigid insulative material and defines a surface mounting face 54 and an oppositely-directed mating face 56 with a plurality of terminal passages 58 extending therethrough. A like plurality of pin terminals 60 are provided each having a pin portion 62 and a surface mounting solder tail 64 also defined by a cantilever beam segment 66 extending at an oblique angle from the axis of the pin portion 62 and a reversedly turned free end 68 defining a bight or nose 70, see FIG. 3. This plug housing 54 also includes an elongated bus bar groove 72, at least one bus bar leg passage 74 and commoning clip cavities 76, 78. The plug member 18 includes a bus bar 80 which is substantially identical to the bus bar 46. The bus bar 80 has a body 82 with at least one depending leg 84. The bus bar is received in the elongated longitudinally extending slot 72 in the plug housing 42 and is retained therein either by friction fit or by barbs 85.

The subject invention also includes at least one generally H-shaped commoning clip 86 which has a pair of generally parallel, spaced legs 88, 90 integrally joined by cross bar 92 to define oppositely directed first and second bus bar receiving slots 94, 96. Each leg 88, 90 also has an outwardly-directed mounting lug 98, 100 and an elongated slot 102, 104, providing resiliency which enables mounting lugs 98, 100 to engage in cavities 42, 44 without communicating force to compress slots 94, 96.

The subject connector 10 may be soldered to a circuit board 12, as shown in FIG. 1, by any of the well-known techniques, such as vapor phase soldering. The connector housings 20, 52 would first be loaded with the appropriate terminals 28, 60, bus bars 46, 80, and clips 86 and then positioned on the circuit board surface. The legs 50, 84 of the bus bars 46, 80 preferably make a light press fit into appropriate apertures 106 of the circuit board 12, see FIG. 3, thereby obviating the need for fixturing to secure the connector 10 to the board 12 during soldering.

The particular design of the solder tail portions 32, 64 of the terminals 28, 60 of the present invention provide a number of advantages. For example, their dimensioning and configuration are such that the solder fillet 108, 110 is axially displaced from the mating axis of the terminals 28, 60. This allows limited flexure of the solder tails 32, 64 to reduce fatigue of the fillet 108, 110 due to mating forces between the terminals 28, 60. The solder tails are long enough to provide compliance, eliminating over-stress of the solder fillets over the length of the connector due to the thermal coefficient of expansion mismatch and mechanical warp between the circuit board and the connector. The solder fillets 108, 110 are displaced to pads 112, 114 at the edge of the connector to allow optical and/or visual inspection for quality control. Further, the solder tail 32, 64 is positioned to serve as test points, as can best be appreciated from FIG. 3. The solder tails 32, 64 are relatively short thereby reducing signal length over the uncontrolled impedance portion of the connector. Also, the shape of the terminal passages 26, 58 should be noted in FIG. 3. The passages 26, 58 are profiled to accommodate the solder tails 32, 64 in such a manner as to prevent overflexure by abutting against free end portions 36, 38 while shrouding the tails to prevent damage and/or misalignment with a respective circuit pad.

Figure 4:
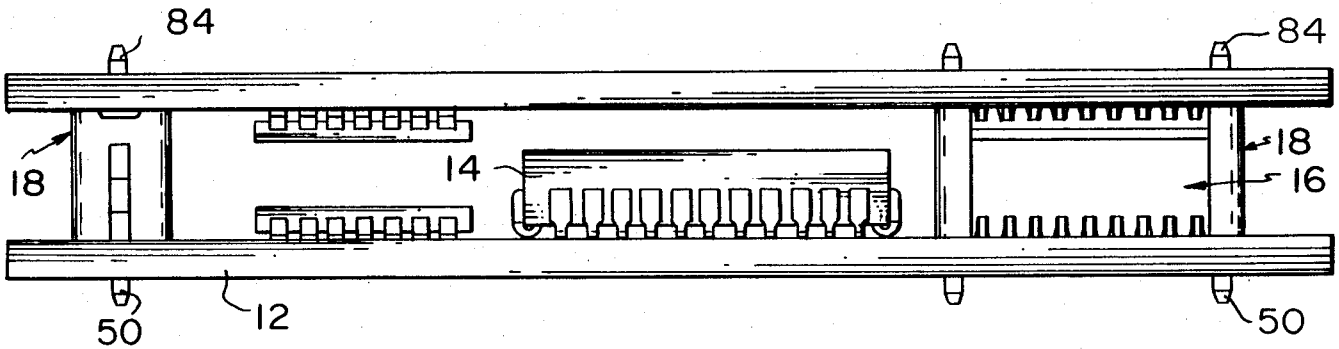
FIG. 4 is a side elevation of a pair of circuit boards, similar to that of FIG. 1, shown interconnected by connectors according to the pesent invention.

FIGS. 1 and 4 show another feature of the present invention which may not be initially apparent. The plug and receptacle housings 20, 52 are quite similar in profile and can be substituted to key or polarize the circuit board 12 for a stacking assembly, such as shown in FIG. 4. A connector 10 is shown in FIG. 1 at each end of the circuit board 12 and pairs of connectors 10 are shown in aligned spaced condition on both elongated side joined by continuous bus bars which are longer versions of bus bars 46, 80.

The bus bars 46, 80 serve to stiffen the circuit board 12 and to provide a high current power or ground path over the circuit board. The legs of the bus bars can be configured for optional additional circuit connections by any well-known technique. Also, by having the mated bus bars at ground potential, terminals on each side of the grounded bus (which becomes a ground plane) develop a characteristic controlled impedance.

The commoning clips 86 are installed prior to mating of a plug 18 in a receptacle 16. Clips 86 are placed in the slots 42, 44 of housing 20 with the clip slot 96 receiving bus bar 46 therein. The slots 102, 104 provide some resiliency for the legs 88, 90 to assure that the lugs 98, 100 will engage in cavities 42, 44 of the housing 20 without compressing slots 94, 96. Mating of the connector would engage the other bus bar 80 in the opposite clip slot 94.

The connector members 16, 18 are retained on their respective circuit boards 12 and restrained against pull-out during connector unmating by the solder fillets 120, 122 which bond the legs 50, 84 to the pads 116, 118, located on the opposite side of the circuit board from the respective connector member.

The bus bars 46, 80 have been shown with additional slots and feet. The slots allow limited flexure of the legs 50, 84 to accommodate tolerances in holes 106, especially for multiple legs requiring multiple hole alignment. The feet serve to limit the insertion of the connector member so as to avoid excessive deformation of solder tails 32, 64.

I claim:

1. A surface mount, miniature, bussing connector for mounting on a printed circuit board, comprising:

mutually mating plug and receptacle members each having a housing of insulative material defining a mating face, the plug and receptacle members being connectable on mutually mating faces, and an oppositely-directed surface mounting face with a plurality of terminal passages extending between said faces, each said housing having an elongated bus bar receiving groove extending longitudinally along the respective mating face and with at least one leg passage connecting said groove to said surface mounting face;

a pluality of compliant electrical terminals each mounted in a respective terminal passage of a respective one of said housing, each terminal having a mating portion directed towards said mating face and a compliant solder tail extending from said surface mounting face for being soldered to the circuit board; and a bus bar affixed in each said connector housing groove, each said bus bar being an elongated member of rigid conductive material having at least one depending leg which extends through said leg passage beyond the surface mounting face of the respective connector to engage in a bore in said circuit board.

2. A surface mount, miniature, bussing connector according to claim 1 wherein said solder tail comprises:

a cantilever beam extending from one end of each said terminal at an oblique angle whereby the subsequently formed solder fillet is displaced toward the side of the connector from the mating axis of the terminal whereby the compliant mounting of said terminal is not reduced by solder.

3. A surface mount, miniature, bussing connector according to claim 2 wherein the free end of said cantilever beam is bent upon itself to form a bight exposed at the side of said connector serving both solder inspection and electrical testing functions.

4. A surface mount, miniature, bussing connector according to claim 3 wherein said terminal passages are profiled to form an abutment against which said free end engages to limit flexure of said solder tail.

5. A surface mount, miniature, bussing connector according to claim 1 further comprising at least one H-shaped commoning clip adapted to interconnect bus bars of mating connector members, each said housing having at least one clip receiving cavity extending normal to and intersecting said bus bar receiving groove.

6. A surface mount, miniature, bussing connector according to claim 5 wherein the side legs of each said H-shaped commoning clip each have an outwardly directed lug and a central slot running a major portion of the length of each said leg to impart resiliency thereto to retain said clip in one of said housings during unmating.

7. A surface mount, miniature, bussing connector according to claim 1 wherein each said bus bar is substantially centrally located between parallel spaced rows of terminals to control the impedance of said connector.

8. A surface mount, miniature, bussing connector according to claim 1 wherein said legs of said bus bars are profiled to accept further electrical connection.

9. A surface mount, miniature, bussing connector according to claim 1 wherein at least one said bus bar is formed of sufficient length to be received in at least two connector housings aligned on a single surface.

10. A surface mount, miniature, bussing connector according to claim 1 further comprising:

said bores on said printed circuit boards comprising means receiving said at least one depending leg of said bus bar in a circuit board whereby unmating forces are withstood without damage to the engagement of the solder tails to their respective pads.

11. A surface mount, miniature, bussing connector according to claim 10 wherein said at least one depending leg is secured to the side of the circuit board opposite the connector.

12. A surface mount, miniature, bussing connector according to claim 10 wherein each said at least one depending leg is profiled for gripping engagement with a respective connector housing and circuit board.

13. A surface mount, miniature, bussing connector according to claim 10 wherein each said at least one depending leg is profiled to accommodate for tolerancing of said bores.

14. A surface mount, miniature, bussing connector according to claim 1 wherein each said bus bar further comprises means limiting the insertion of said bus bar into said bores of said circuit board and assuring registration between said solder tails and their respective pads.

15. A surface mount, miniature, bussing assembly for interconnecting printed circuit boards comprising:

a plurality of separate mating plug and receptacle members each having a housing of insulative material defining a mating face and an oppositely-directed surface mounting face with a plurality of terminal passages extending between said faces, each said housing having an elongated bus bar receiving groove extending longitudinally along the respective mating face and with at least one leg passage connecting said groove to said surface mounting face;

a plurality of electrical terminals each mounted in a respective terminal passage of a respective one of each of said housings, each terminal having a mating portion directed towards said mating face and a solder tail extending from said surface mounting face for electrical connection to the circuit boards; and a bus bar in each said connector housing groove, each said bus bar being an elongated member of rigid conductive material having at least one depending leg which extends through said leg passage beyond the surface mounting face of the respective connector to engage in a bore in one of said circuit boards, a single bus bar extending through grooves in plural plug members and a separate bus bar extending through grooves in plural receptacle members.

* * * * *